US005969311A

United States Patent [19]

Mader

[11] Patent Number: 5,969,311

[45] Date of Patent: Oct. 19, 1999

[54] MECHANICAL INERTIA SWITCH

[75] Inventor: Gerhard Mader, Thalmassing, Germany

[73] Assignee: Siemens Aktiengesellschaft, Munich, Germany

[21] Appl. No.: 08/892,364

[22] Filed: Jul. 14, 1997

Related U.S. Application Data

[63] Continuation of application No. PCT/DE96/00035, Jan. 12, 1996.

[30] Foreign Application Priority Data

Jan. 12, 1995 [DE] Germany ..... 195 00 737
Mar. 7, 1995 [DE] Germany ..... 195 08 014

[51] Int. Cl.[6] ..... H01H 35/02

[52] U.S. Cl. ..... 200/61.49

[58] Field of Search ..... 200/61.45 M, 200/61.48, 61.49, 61.5, 61.51, 61.52; 73/514.38

[56] References Cited

U.S. PATENT DOCUMENTS

| | | | |
|---|---|---|---|
| 3,716,810 | 2/1973 | Hara et al. | 335/154 |
| 3,778,572 | 12/1973 | Matsui et al. | 200/61.45 M |
| 4,811,153 | 3/1989 | Sakatos | 361/88 |
| 5,457,293 | 10/1995 | Breed | 200/61.52 |
| 5,692,580 | 12/1997 | Maiwald et al. | 180/282 |

FOREIGN PATENT DOCUMENTS

| | | |
|---|---|---|
| 3609054C1 | 4/1986 | Germany . |
| 3638360C2 | 2/1989 | Germany . |
| 3742202A1 | 6/1989 | Germany . |
| 3929082 A1 | 6/1990 | Germany . |
| 4002845C1 | 6/1991 | Germany . |
| 4007726 A1 | 9/1991 | Germany . |
| 4143032A1 | 7/1992 | Germany . |
| 4126107C2 | 12/1993 | Germany . |

OTHER PUBLICATIONS

"Bauelemente der Feinmechanik" (components of precision mechanics), O. Richter et al., Verlag Technik Berlin, 1952, pp. 324–327.

*Primary Examiner*—Wynn Wood Coggins
*Assistant Examiner*—Michael J. Hayes
*Attorney, Agent, or Firm*—Herbert L. Lerner; Laurence A. Greenberg

[57] ABSTRACT

A mechanical inertia switch in a housing has an elastic tongue with an inertial mass as well as a contact piece. The elastic tongue has a stable neutral position and can be moved in the direction of the contact piece against a force, for example a magnetic force or a force due to preloading of the elastic tongue, which acts in addition to a spring force of the elastic tongue. The compact mechanical inertia switch has a small number of components and short switching times. The elastic tongue is prevented from oscillating. It is thus possible to use the mechanical inertia switch as a safing sensor for detecting side impact.

19 Claims, 1 Drawing Sheet

MECHANICAL INERTIA SWITCH

CROSS-REFERENCE TO RELATED APPLICATION

This application is a continuation of International Application Ser. No. PCT/DE96/00035, filed Jan. 12, 1996.

BACKGROUND OF THE INVENTION

1. Field of the Invention

The invention relates to a mechanical inertia switch, having a housing, an inertial mass disposed at an electrically conductive elastic tongue, and a contact piece.

Such an inertia switch, which is known from German Patent DE 35 09 054 C1, has an inertial mass which is disposed at an elastic tongue, and a contact piece. The electrically conductive elastic tongue and the contact piece are guided through the housing and each have an electrical contact at their free ends. The elastic tongue, with the inertial mass, is deflected in the direction of the contact piece under the effect of an acceleration. If the acceleration is sufficient, an electrical connection is made through the two electrical contacts on the elastic tongue and on the contact piece.

With an inertia switch of that type, short switching times can only be achieved at the cost of an unreliable response. What is more, if the inertia switch is used in a vehicle, the inertia switch is exposed to vibrations which can make the elastic tongue oscillate and thus result in inadvertent closure of the inertia switch.

SUMMARY OF THE INVENTION

It is accordingly an object of the invention to provide a mechanical inertia switch, which overcomes the hereinafore-mentioned disadvantages of the heretofore-known devices of this general type and which prevents electrical connection between an elastic tongue and a contact piece due to oscillations of the contact piece so long as an acceleration force acting on the inertia switch is below a defined limit value, even though dimensions of the switch are small.

If an inertia switch of the type mentioned at the outset is to be used as a safing sensor or safety switch for detecting lateral impact in motor vehicles, only an extremely short period of time should elapse between an impact and the triggering of safety devices. The switching time of the switch subject to the acceleration contributes to that period of time. In the case of an inertia switch of the type mentioned at the outset, the switching time is primarily dependent on the distance between the electrical contacts. If that distance is very small, then it is possible for even a small acceleration force, in particular one having a frequency component which is equal to the resonant frequency of the system including the elastic tongue and the inertial mass, to excite the elastic tongue with the inertial mass, into oscillations and thereby make an electrical connection between the elastic tongue and the contact piece. That may result in unintended triggering of restraint devices in the motor vehicle. That problem is not solved by increasing the distance between the elastic tongue and the contact piece, while simultaneously increasing the elasticity of the elastic tongue, since a higher elasticity of the elastic tongue only makes the latter more susceptible to oscillations. Tests have shown that on its own, the spring force of the first elastic tongue is not sufficient for the required damping of oscillations of the elastic tongue.

With the foregoing and other objects in view there is provided, in accordance with the invention, a mechanical inertia switch, comprising a housing; an electrically conductive elastic tongue having a spring force; an inertial mass disposed at the elastic tongue, the inertial mass having a neutral position and being kept steadily or stably in the neutral position by a force acting in addition to the spring force; and a contact piece disposed at a distance of less that 300 $\mu$m from the elastic tongue in the neutral position.

In accordance with another feature of the invention, there is provided a shaped part made of material having high permeability, the inertial mass being a magnet forming a magnetic circuit with the shaped part, the inertial mass and the shaped part having a minimal separation in the neutral position of the inertial mass, and the shaped part disposed in or on the housing. In accordance with a further feature of the invention, the shaped part is a flexurally stiff pin guided through the housing parallel to the elastic tongue.

In accordance with an added feature of the invention, the distance between the elastic tongue in the neutral position and the contact piece is less than 150 $\mu$m.

In accordance with an additional feature of the invention, the contact piece is an elastic tongue. In accordance with yet another feature of the invention, the contact piece has greater flexural stiffness than the elastic tongue.

In accordance with yet a further feature of the invention, the housing is at least partially made of glass and is filled with protective gas.

In accordance with yet an added feature of the invention, the housing, the elastic tongue and the contact piece are constructed as a reed switch.

In accordance with yet an additional feature of the invention, the elastic tongue is preloaded.

In accordance with again another feature of the invention, the housing, the elastic tongue and the contact piece are constructed as a dry reed switch or protective gas contact in a metal housing.

In accordance with again a further feature of the invention, there is provided a further contact piece to which the elastic tongue is electrically connected in the neutral position.

In accordance with again an added feature of the invention, the elastic tongue is electrically connected to the flexurally stiff pin in the neutral position.

In accordance with again an additional feature of the invention, the inertial mass is a local supplementary mass of the elastic tongue.

In accordance with still another feature of the invention, the elastic tongue has a free end with a region defined by contact points between the elastic tongue and the contact piece when the elastic tongue is deflected from the neutral position, and the inertial mass is disposed in the vicinity of the region.

In accordance with a concomitant feature of the invention, the contact piece or the elastic tongue is guided through the housing.

Other features which are considered as characteristic for the invention are set forth in the appended claims.

Although the invention is illustrated and described herein as embodied in a mechanical inertia switch, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
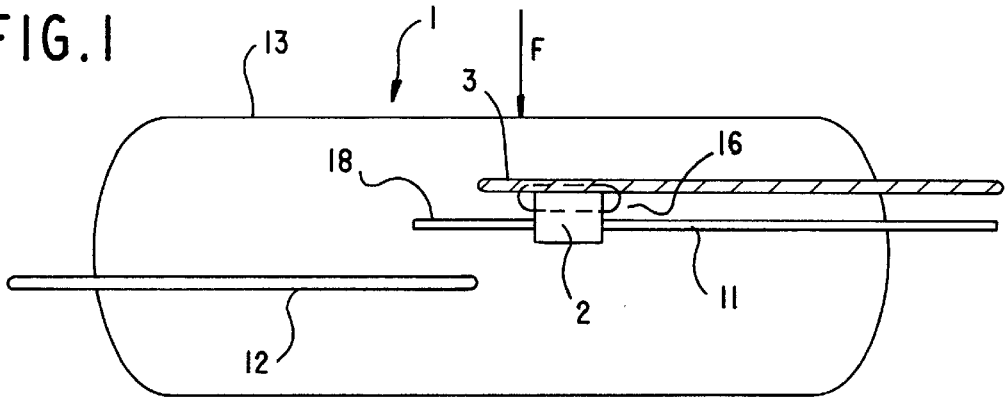
FIG. 1 is a diagrammatic, longitudinal-sectional view of a first illustrative embodiment of a mechanical inertia switch in a stable state.

Referring now in detail to the figures of the drawings, in which the same elements are provided with the same reference numerals, and first, particularly, to FIG. 1 thereof, there is seen an inertia switch 1 which includes a housing 13 having an elastic tongue 11 and a contact piece 12 that is likewise constructed as an elastic tongue. An inertial mass 2 is disposed on the elastic tongue 11. A shaped body 3 in the form of a pin is disposed parallel to the elastic tongue 11.

The elastic tongue 11 and the contact piece 12 are guided through the housing 13, parallel to each other and at different levels on opposite sides of the housing 13. The elastic tongue 11 and the contact piece 12 are firmly clamped at the locations where they are guided through the housing 13. The elastic tongue 11, with the inertial mass 2, can be moved from its stable neutral position in the direction of the contact piece 12, so that if there is a sufficient force perpendicular to the longitudinal direction of the elastic tongue 11 and directed from the elastic tongue 11 toward the contact piece 12, the free end of the elastic tongue 11 touches the contact piece 12.

Due to the placement of the inertial mass 2 on the elastic tongue 11, the elastic tongue 11 and the inertial mass 2 are sensitive to acceleration forces F in the aforementioned direction, because of the inertia of the elastic tongue 11 and the inertial mass 2. The spring force of the elastic tongue 11 opposes an acceleration force F in this case.

The inertial mass 2 is a magnet which forms a magnetic circuit 16 with the shaped body 3 made of a material having high permeability. The shaped body 3 in this case is disposed in such a way that the distance between the shaped body 3 and the inertial mass 2 is minimal when the elastic tongue 11 is in the neutral position. An acceleration force F which is greater than the spring force of the elastic tongue 11 plus the magnetic holding force between the inertial mass 2 and the shaped body 3 causes a deflection of the elastic tongue 11 in the direction of the contact piece 12 and makes an electrical connection. The elastic tongue 11 may additionally be preloaded by virtue of the magnetic holding force. The magnetic holding force between the inertial mass 2 and the shaped body 3 avoids unintentional oscillation of the elastic tongue 11.

The contact piece 12 has greater flexural stiffness than the elastic tongue 11, in order to avoid oscillation of the contact piece 12 for its part. The elasticity of the elastic tongue 11 and the magnitude of the magnetic holding force between the inertial mass 2 and the shaped body 3, as well as the placement of the inertial mass 2 along the elastic tongue 11, define an acceleration threshold above which the inertia switch 1 switches.

The contact travel, that is to say the distance between the elastic tongue 11 and the contact piece 12, is small with the aim of achieving a short closing time of the inertia switch 1. The inertial mass 2 is disposed along the elastic tongue 11 in the vicinity of a region at the free end 18 of the elastic tongue 11 which is defined by the contact or the contact points between the elastic tongue 11 and the contact piece 12, when the elastic tongue 11 is deflected from it neutral position. If the inertial mass 2 is made of an electrically conductive material, it is also possible for it to be disposed at the end of the elastic tongue 11.

Figure 3:
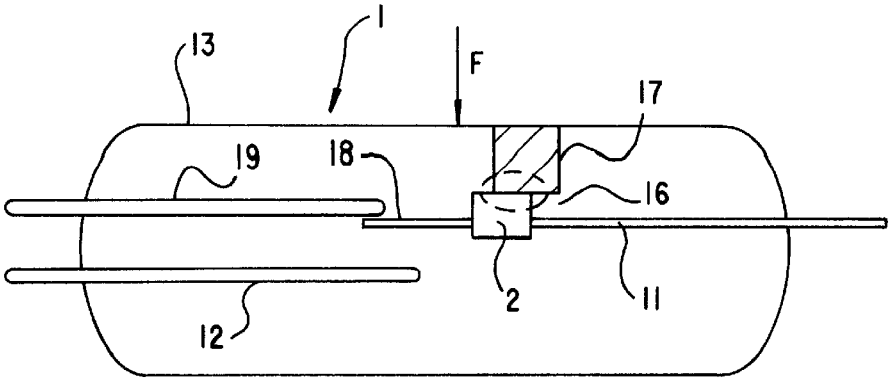
FIG. 3 is a diagrammatic, longitudinal-sectional view of a third illustrative embodiment of a mechanical inertia switch in a stable state.

It is also possible for the elastic tongue 11 to be guided through the housing 13 on the same side of the housing as the contact piece 12. In its configuration as a flexurally stiff pin, the shaped body 3 can be guided through the housing 13 both on the side of the housing on which the elastic tongue 11 is also guided through the housing 13, and on the side of the housing opposite to that side of the housing. In its configuration as a flexurally stiff pin, the shaped body 3 can also be guided through the housing on both sides of the housing. The shaped body 3, 17 may have any other configuration and be disposed in or on the housing 13 (FIG. 3).

The inertial mass 2 may also be made of a material having high permeability and may form a magnetic circuit with a magnet. In this case the magnet may be disposed on the shaped body 3, which is then made of any desired material. The shaped body 3 may even be the magnet in this case.

In one configuration of the inertia switch 1, according to FIG. 1, the housing 13 electrically insulates the elastic tongue 11 and the contact piece 12. A housing 13 of this type is preferably made of glass, at least in the region where the elastic tongue 11 and the contact piece 12 are guided through. The hermetically sealed housing 13 may be filled with protective gas, in order to prevent corrosion of the elastic tongue 11 or the contact piece 12.

Preferably, a conventional reed switch, with its glass housing filled with protective gas and its two elastic tongues, is converted into the inertia switch 1 according to the invention, merely by placing an inertial mass on one of the elastic tongues and placing the shaped body in or on the housing of the reed switch.

The elastic tongue 11 may have a local supplementary mass as the inertial mass. A local supplementary mass on the elastic tongue 11 is superfluous if the elastic tongue 11 itself has sufficient inertia.

The inertia switch 1 may also be constructed as a change-over switch. To that end, in the neutral position of the elastic tongue 11, it is electrically connected to a further contact piece 19 (FIG. 3). The electrical connection between the elastic tongue 11 and the further contact piece results from contact between the free end of the elastic tongue and the further contact piece, or from contact between the inertial mass 2 and the further contact piece, on the condition that the inertial mass 2 is made of an electrically conductive material. Accordingly, it is also possible for the shaped body 3, in particular in its configuration as a flexurally stiff pin, to undertake the function of the further contact piece, on the condition that the shaped body 3 is made of an electrically conductive material. What has been said concerning the electrical insulation of the further contact piece from the housing 13 and its placement in or on the housing 13 also applies to the elastic tongue 11 and the contact piece 12.

Figure 2:
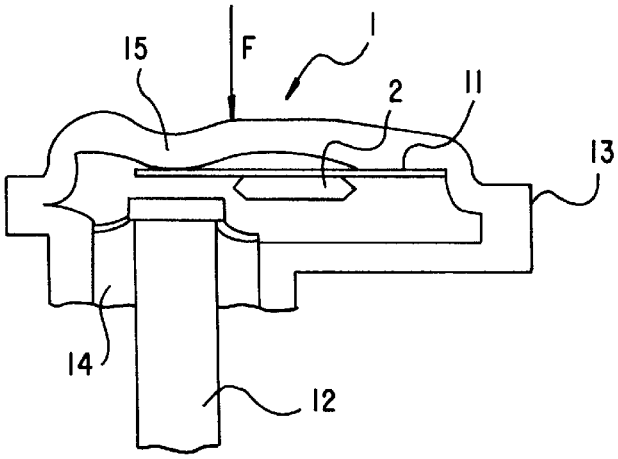
FIG. 2 is a fragmentary, longitudinal-sectional view of a second illustrative embodiment of a mechanical inertia switch in a stable state.

In the embodiment according to FIG. 2, the inertia switch 1 has a metal housing 13, in which an elastic tongue 11 with an inertial mass 2 is disposed. A contact piece 12 is guided through the housing 13 in an electrically insulated manner, through the use of a prestressed-glass seal 14. A cavity within the housing 13 is filled with protective gas.

The elastic tongue 11 is preloaded by a local indentation 15 of the housing. An additional spring force due to the preloading prevents the elastic tongue 11 from oscillating.

The embodiments presented herein for the inertia switch 1 are open in the stable state. It is likewise possible for them to be closed in the stable state and to open in the event of an acceleration force which exceeds a defined limit value.

The configuration of the inertia switch 1 as a change-over switch on one hand has the advantage of permitting stages during which the inertia switch 1 is equipped with components to be detected during the manufacturing process, and on the other hand detects an additional factor for detecting defective switch components and a break in a soldered joint at a connection between the further contact piece, the elastic tongue 11 and a printed circuit board carrying an evaluation circuit, with the emission of a signal when the inertia switch 1 is in the neutral position.

The inertia switch 1 can be used as a safing sensor in motor vehicles for detecting impact and activating safety devices. The inertia switch 1 according to the invention is suitable in this case for detecting front and back impact, as well as for detecting side impact or impact from any other direction. When the inertia switch 1 is used as a safing sensor for detecting side impact, the inertia switch 1 has a contact travel, defined as a distance between the elastic tongue 11 in its neutral position and the contact piece 12, of preferably less than 300 $\mu$m, or 150 $\mu$m, in order to achieve short switching times.

In addition to the spring force of the elastic tongue 11, and the acceleration force acting on the elastic tongue 11 and the inertial mass 2, the contact travel determines the closing time of the inertia switch. The closing time, which is measured from deflection of the elastic tongue 11 from its neutral position to closure of the contacts between the elastic tongue 11 and the contact piece 12, must not exceed about 3 milliseconds, since in the event of impact a side airbag system must have been triggered about 5 milliseconds after the start of impact, and about 2 milliseconds elapse before the acceleration has reached the threshold value above which the elastic tongue of the inertia switch leaves its neutral position. The switching time is less than 3 milliseconds taking into account the fact that the safing sensor of an airbag activation system should emit a signal at a time before the actual triggering time. An extremely short contact travel in this case is the decisive parameter for a short switching time.

The inertia switch 1 may be encapsulated with a soft plastic in order to protect it against mechanical effects and impact if it is dropped. The additional plastic layer also makes the inertia switch 1 easier to handle during manufacture. It can also be constructed as an SMD component.

Due to the use of elastic tongues and contact pieces having dimensions which are small, the inertia switch 1 according to the invention has a small volume and weight, on the order of a conventional reed switch, and even less in its configuration as a dry reed switch or inert gas contact in a metal housing according to the invention. The steps in the manufacturing process are also reduced by the modification of commercially available components according to the invention, such as, for example, a reed switch or a dry reed switch or inert gas contact in a metal housing. The number of components in the inertia switch 1 according to the invention is minimized.

I claim:

1. A mechanical inertia switch, comprising:

a housing;

an electrically conductive elastic tongue disposed at least partly in said housing and having a spring force;

an inertial mass disposed at said elastic tongue, said inertial mass having a neutral position and being kept steadily in said neutral position by a force acting in addition to said spring force; and a contact piece disposed at least partly in said housing at a distance of less than 300 $\mu$m from said elastic tongue in said neutral position.

2. The inertia switch according to claim 1, including a shaped part made of material having high magnetic permeability, said inertial mass being a magnet forming a magnetic circuit with said shaped part, said inertial mass and said shaped part having a separation in said neutral position of said inertial mass smaller than a separation thereof in a deflected position of said inertial mass, and said shaped part disposed in said housing.

3. The inertia switch according to claim 1, including a shaped part made of material having high magnetic permeability, said inertial mass being a magnet forming a magnetic circuit with said shaped part, said inertial mass and said shaped part having a separation in said neutral position of said inertial mass smaller than a separation thereof in a deflected position of said inertial mass, and said shaped part disposed on said housing.

4. The inertia switch according to claim 2, wherein said shaped part is a flexurally stiff pin extending into said housing parallel to said elastic tongue.

5. The inertia switch according to claim 3, wherein said shaped part is a flexurally stiff pin extending into said housing parallel to said elastic tongue.

6. The inertia switch according to claim 1, wherein said distance between said elastic tongue in said neutral position and said contact piece is less than 150 $\mu$m.

7. The inertia switch according to claim 1, wherein said contact piece is another elastic tongue.

8. The inertia switch according to claim 7, wherein said contact piece has greater flexural stiffness than said elastic tongue.

9. The inertia switch according to claim 1, wherein said housing is at least partially made of glass and is filled with inert gas.

10. The inertia switch according to claim 1, wherein said housing, said elastic tongue and said contact piece are constructed as a reed switch.

11. The inertia switch according to claim 1, wherein said elastic tongue is preloaded.

12. The inertia switch according to claim 1, wherein said housing, said elastic tongue and said contact piece are constructed as a dry reed switch contact in a metal housing.

13. The inertia switch according to claim 1, including a further contact piece to which said elastic tongue is electrically connected in said neutral position.

14. The inertia switch according to claim 4, wherein said elastic tongue is electrically connected to said flexurally stiff pin in said neutral position.

15. The inertia switch according to claim 5, wherein said elastic tongue is electrically connected to said flexurally stiff pin in said neutral position.

16. The inertia switch according to claim 1, wherein said inertial mass is a local supplementary mass of said elastic tongue.

17. The inertia switch according to claim 1, wherein said elastic tongue has a free end with a region defined by contact points between said elastic tongue and said contact piece when said elastic tongue is deflected from said neutral position, and said inertial mass is disposed in the vicinity of said region.

18. The inertia switch according to claim 1, wherein said elastic tongue is extending into said housing.

19. The inertia switch according to claim 1, wherein said contact piece is extending into said housing.

* * * * *